United States Patent [19]

Small et al.

[11] 4,134,270

[45] Jan. 16, 1979

[54] MINE ROOF SUPPORT CONTROL

[75] Inventors: Fred Small, Lathom; Kenneth Darbyshire, Platt Bridge, Near Wigan, both of England

[73] Assignee: Gullick Dobson Limited, England

[21] Appl. No.: 753,161

[22] Filed: Dec. 21, 1976

[30] Foreign Application Priority Data

Dec. 23, 1975 [GB] United Kingdom ..... 52537/75
Mar. 27, 1976 [GB] United Kingdom ..... 12444/76

[51] Int. Cl.[2] ..... E21D 15/44
[52] U.S. Cl. ..... 405/302
[58] Field of Search ..... 61/45 D, 63; 299/31-33; 91/170 MP, 1, 189; 248/357

[56] References Cited

U.S. PATENT DOCUMENTS

| | | | |
|---|---|---|---|
| 3,489,460 | 1/1970 | Cooper | 61/45 D X |
| 3,495,499 | 2/1970 | Ward | 61/45 D X |
| 3,531,159 | 9/1970 | Schmidt | 61/45 D X |
| 3,643,445 | 2/1972 | Schmidt | 61/45 D |

*Primary Examiner*—Dennis L. Taylor
*Attorney, Agent, or Firm*—William Anthony Drucker

[57] ABSTRACT

A mine roof support control monitoring system in which at least some of a row of self advancing mine-roof supports at a mine face each include means for providing data relating to successive advances of that support. This data is accumulated by other means of the system and stored to give readily available indicationsof differences of actual support advances. The system preferably further includes means for pre-energizing the advance mechanisms of such supports to eliminate data relating to slack or tolerance.

14 Claims, 5 Drawing Figures

16
14
10
11
15
16
12
13

34
37
34
39
32
32
36
26
31
33
&
27
33
31
&
30
DECODE
30
DECODE
38
&
20
20
20
46
&
47
45
COMMAND
&
ADDER
48
55
28
52
53
VDO
54
51
STORE
49
25

66
M
R
F
72
INTERLOCKS
M
71
PILOT
FROM
ADV. SOL.
65
ADVANCE
PUSH
69
M
68
F
R
M

MINE ROOF SUPPORT CONTROL

The invention relates to mining, and has particular application in remote control systems for self-advancing mine-roof supports.

At the mineral face of a mine working it is normal to have a row of self-advancing mine-roof supports cooperating with a face conveyor and a mining machine that traverses the face to cut material which is carried by the face conveyor to conveyor systems usually in a gate at one end of the face for transportation away from the face. It is common practice for the mine-roof supports to be equipped with pressure-fluid-operated means so as to be advanced sequentially. Each support serves first in pushing the face conveyor towards the face behind the mining machine as it traverses the face. When there is at least a predetermined headway on the mining machines the mine-roof supports are sequentially lowered usually one at a time, and pulled towards the face conveyor whereupon they are reset to the roof. Any attempt to automate these operations will meet the usual demand that the face be kept straight and the services of surveyors are required to ensure that the advances of the mine-roof supports do not result in unwanted curvature of the face, as would result from differential advances of the supports, particularly over a succession of advances thereof.

It is an object of this invention to provide means to facilitate the maintenance of desired relative positions of self-advancing mine-roof supports, and to this end the invention proposes a system for monitoring the relative positions of such supports by separately accumulating and storing data relating to successive actual advances for at least some of the supports.

Preferably, the data accumulated concerns erros between actual advances and specified advance distances, though, clearly, accumulation of actual advance data would give, for the supports concerned, totals from which corrections could readily be made.

In a preferred embodiment of the invention, such a central system comprises a plurality of separate support-related units each for receiving and translating coded electrical control signals into support advance implementing signals, and for supplying coded electrical data signals representative of the extent of an advance movement of the related support, a control unit, and a communication network for carrying the said control and a data signal between the support-related units and the control unit, the control unit including resettable means responsive to the data signals for accumulating, for each mine-roof support, individual differences from successive desired advances or even the numerical values of the data signals themselves.

In implementing such a system, the control unit may be provided with word-organised binary data storage means having at least one word location dedicated to each support, and accumulator or adder means for updating the contents of each such word location at the time of an advance of the corresponding support. The word locations may be registers driving a single numerical display via register scanners or other means, or driving individual numerical displays or parts of a display, or may be part of a word-organised writable semiconductor store, often referred to as a RAM, included in a controlling computer system associated with a visual display for accumulated error or total advance data.

The support-related units may supply a direct digitised representation of the extent of an advance, in which case the control unit may compare incoming data signals with a preset datum value, say by a subtractor or in a subtraction operation. Alternatively, the support related units may supply an offset from a preset desired advance of the corresponding support, in which case the control unit will simply accumulate incoming data signals, which should, of course, include a sign indication, using an adder or an addition operation in a computer, preferably a micro-computer, system.

Such a system will therefore store, and display as required, indications of the extents to which individual mine roof supports exceed or fall short of a total advance represented by the number of advance cycles which have taken place since the storage means was reset. Initially, or periodically, such resetting will take place following a survey of the face and adjustment of the positions of the supports until they have a desired relative relationship. At the time of each such re-survey the monitoring system can supply correction data via the display. System embodying this this invention are therefore particularly well adapted to use in a mine face control system that provides for automatic advancing of the supports in an automatic mode of operation, and allows support position adjustments or corrections by an operator in a separate manual mode of operation, which, if desired, may be one of two manual modes, one latched to achieve a preset advance and the other unlatched to advance for as long as there is a manual demand for it. Provision could be made so that, during the correction operation, the accumulated error for a particular support is displayed and offset automatically in accordance with the positional adjustment made, thereby automatically resetting the storage means.

Preferred self-advancing mine-roof supports use a double-acting hydraulic ram for pushing the face conveyor and pulling the support, and known devices, for example using potentiometers, for measuring the extension or stroke of the ram and thus the extent of the advance. Such devices may be associated with selective presets to control a maximum or desired advance and/or supply a different signal relative to an adjustable preset.

It would, of course, be equally possible, if not preferable, to use ultrasonic ram extension monitoring devices of the type to which our copending application No. 52259/75 relates.

Often, although the pulling operation to bring a support to the face conveyor is required for every support, it is satisfactory for an even distribution of less than all, say as few as a quarter, of the supports to perform the pushing operation whereby the face conveyor is moved up to the mineral face. In such a system, face adjustment may be satisfactorily monitored using data signals from only those supports that will be involved in pushing the face conveyor.

Adjustment of individual mine roof supports in order to cancel cumulative advance discrepancies and thereby maintain the alignment of the face, places stringent requirements on the accuracy of the advance measuring signal, and it is further desirable herein to facilitate such accuracy.

Accordingly a mine roof support having advance measuring, and signal producing means is, for an advance of the support, made operative to energise its support advance means prior to release of the support from between the floor and the roof, so as to take up any play in the linkages associated with such advance means, the advance measuring and signal producing means being operative after such take-up of play, say on release of the support.

In operating the advance means, typically a pressure-fluid-operated ram, while the roof support is set between the floor and roof, it may be that, in addition to taking up any play, the face conveyor itself, where that acts as an anchorage for the advance means, will also be moved to some extent. However, this will not affect the accuracy of the signal generator in representing actual roof support advance.

In preferred embodiments, a sequencer will be incorporated whereby a support advance phase of operation will, on initiation, automatically cause energisation of the support advance means prior to lowering of the roof-engaging structure of the support to allow the advance to take place. Such a sequencer may be incorporated at the roof supports themselves, say as a predetermined time delay prior to release and lowering of the support, or as a pre-requirement regarding the achievement of a minimum resistance, typically pressure or back pressure, in the support advance means, or even related to sensing roof support ram conditions.

Such a sequencer may be incorporated in the support related coding, decoding and control units of the system of our above-mentioned application. Alternatively, a sequencer may be incorporated in a remote control unit where that unit also issues support control signals to the supports, although it may well be generally preferred for a single signal to initiate predetermined sequenced operation via interlocks or time delays at the support as mentioned above.

The pre-energisation feature may be applied to a conveyor pushing operation preceding the support advance proper and this feature of the invention concerns taking up any play in the support to conveyor linkage prior to measuring the ram stroke and producing corresponding signals, say using a ram pressure sensor for enabling or resetting purposes.

Embodiments of the invention, will now be described, by way of example, with reference to the accompanying drawings, in which.

A mineral face 10 is traversed by a mining machine 11 between a main gate 12 and a tail gate 13. As shown, the mining machine 11 is cutting on a traverse from the main gate to the tail gate. Cutting may also take place for the opposite direction of traverse, or idle return runs may be made.

Figure 1:
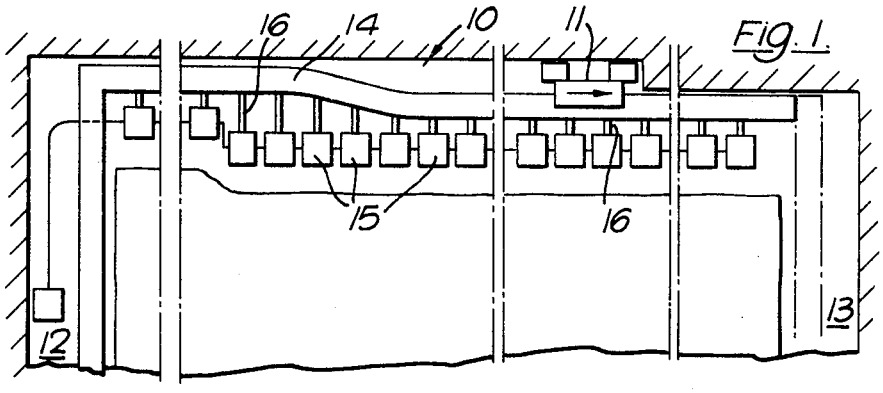
FIG. 1 is a schematic representation of a mineral face working to which the invention is applicable.

The mining machine 11 is associated with a face conveyor 14 to which a row of self-advancing mine supports are attached by double-acting hydraulic rams 16 for pushing the conveyor towards the face 10 and subsequently pulling lowered supports successively up to the face conveyor as indicated at the left hand side of FIG. 1, and so to form the familiar snake of the face conveyor. The supports are raised to engage the roof so that in this way, the roof of the face is left unsupported for a minimum length of time. The face conveyor 14 is shown feeding a conveyor 17 in the main gate for transporting material away from the face. A similar conveyor will be provided in the tail gate if cutting is to take place on both directions of traverse of the mining machine.

Figure 2:
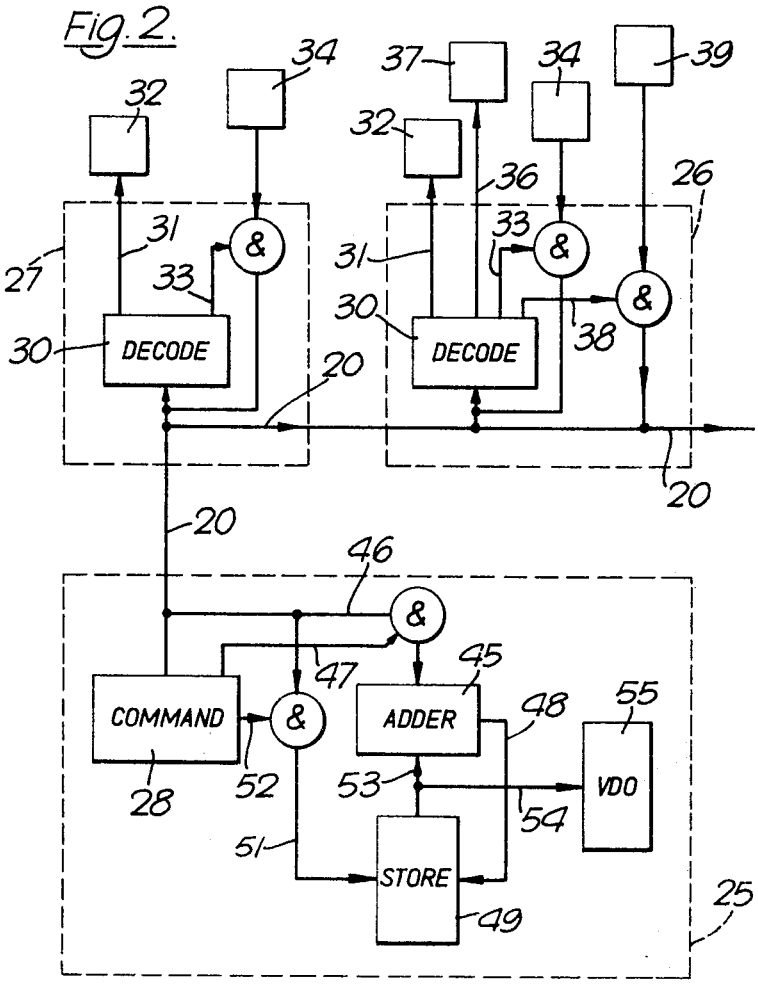
FIG. 2 is a block diagram of a remote control unit and two support-related units.

The supports 15 are shown with interconnecting multi-core cables 20 which form part of a communication network between a remote control unit 25 and support-mounted units indicated in FIG. 2 by the numeral 26. The remote control unit 25 includes command circuitry 28 for supplying coded command signals controlling sequential advances required of the supports 15, and will normally comprise a parallel operating, word organised, micro computer system. These will be transmitted over the multi-core cables 20 to support units such as shown at 26 and 27 for supports that, respectively, do and do not push the face conveyor.

For convenience, it is assumed that coded control or data words are transmitted bit by bit in series over one of the lines of the cables 20. In practice, different lines may be used for the different directions of transmission, with other lines serving for power supplies, clock pulses, emergency warning signals, and audio linking, etc. Alternatively, data and/or control signals may be transmitted in parallel, say a byte at a time over groups of the lines of the cable 20. For the preferred serial mode, some form of word assembler, such as a serial-to-parallel converter, may be required at the input at each of the units 26 and 27 as these will normally be parallel operated, word organised, data processing units, with means performing the opposite function for transmission in the opposite direction.

The supports units 26 and 27 are each shown as including a decoder 30. For the unit 27, decoder 30 is operative to supply control signals over line 31 to a control solenoid 32 for ram action to pull the associated support up to the face conveyor, and a signal on a line 33 enabling output from a pressure detection device 34 for indicating that the hydraulic props of the support are pressed against the roof of the mine working.

In the case of the support units 26, similar functions are controlled by its decoder 30 as indicated by the use of the same reference numerals. In addition, however, decoder output line 36 is also shown connected to a ram control solenoid 37 for controlling the application of pressure-fluid to push the face conveyor towards the mineral face. A further decoder output line 38 is shown for enabling outputs from a ram extension sensor 39 that is assumed to provide a digital output, say by a digitiser from a potentiometer-based device.

In practice the two support units 26 and 27 may well be identical with the additional decoder outputs 36 and 37 not used for every support, though it may be preferred to use a ram extension sensor if desired. For convenience of description it is assumed that the ram extension sensor is operative relative to a preset so that it supplies signals which represent an error in relation to that preset. Alternatively, of course, the total ram extension would be transmitted to the remote control unit.

The remote control unit 25 is shown as including an adder 45, normally the computing arithmetic and logic unit of a micro processor system, with parallel input lines 46 enabled by a control line 47 from the command means 28 when ram extension data is being received. Outputs 48 of the adder 45 are shown feeding a multi-word store 49 normally part of the memory of a microprocessor system, which is addressed over lines 51 according to which support is being controlled at any particular time as determined by the enabling line 52 for controlling up dating of the store addressing facility during an addressing phase when a mine roof support is selected, for example, using a counter.

The store 49 is also shown supplying the adder 45 over lines 53 so that the adder serves to accumulate the present contents of a particular word location of the store with the error or total extension signal for the current advance operation.

Lines 53 are shown branched at 54 to feed a visual display unit 55 so that information regarding accumulated errors can be displayed either individually for each mine roof support, or simultaneously for a plurality or all of the mine roof supports.

Figure 3:
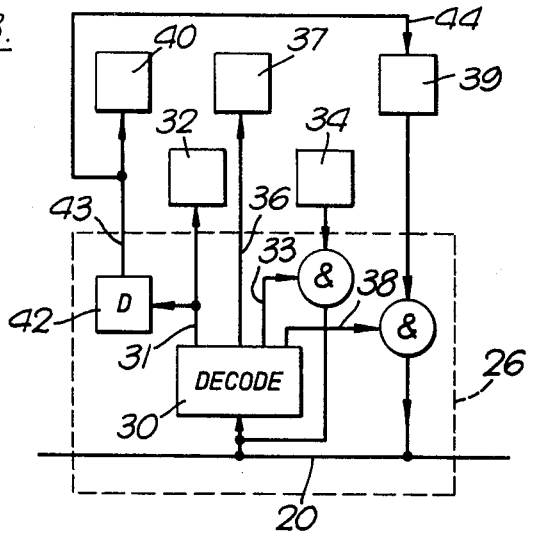
FIG. 3 is a block diagram of a support related unit with advancing ram preenergisation under electronic control.
Figure 4:
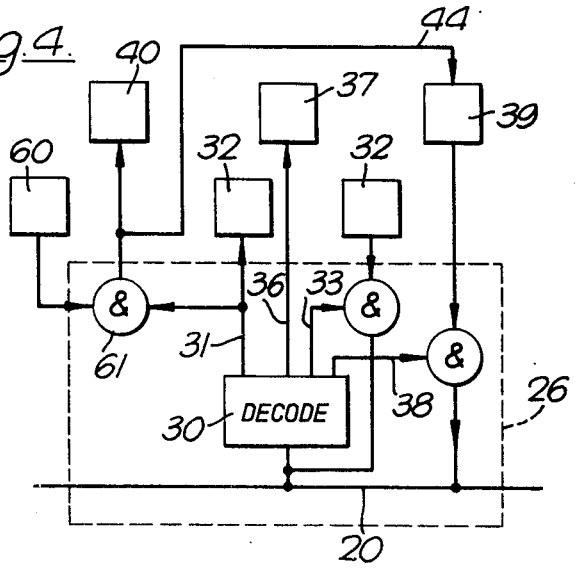
FIG. 4 shows an alternative to FIG. 3.

In FIGS. 3 and 4 the local support control unit 26 is shown as including electrical means for ensuring that play is taken up in the advancing ram linkages before a support is released from the roof and pulled up to the face conveyor thereby ensuring that ram extension data is more accurate. For double-acting roof supporting props the solenoid 40 may control only lowering of the support canopy, or raising too depending on its energisation state and may be suitably interlocked with the other solenoids, or by pressure fluid control valving for automatically advancing on an advance command. FIG. 3 shows a time delay device 42, which could be digital, say a counter responsive to cycles of the remote monitoring unit, or analogue, say an RC network. In its simplest digital form, the delay may be a monostable or bistable device responsive to a subsequent signal from the remote monitoring and control unit.

The timing device is shown connected in the advance ram solenoid energising line 31 after branching to the roof support ram solenoid energising line 43.

FIG. 3 also shows the roof pressure detector 34 for supplying signals to the remote control unit on interrogation by energisation of decoder output line 33, and the ram extension sensor 39 that is assumed to provide a digital output sampled by decoder output lines 38, though an analogue output could be digitised within the unit 26. The roof solenoid line 43 from the delay 42 is shown branched at 44 to the sensor 39 to zero or reset the latter or, for a pulse producing sensor, enable its pulse line.

FIG. 4 shows an alternate arrangement in which a device 60 responsive to pressure in the advance ram is indicated as providing a signal for enabling a coincidence gate 61 between the advance solenoid and roof support solenoid lines 31 and 43.

Alternatively, of course, as will be described in FIG. 5, there may be a pressure-fluid servo interlock between the support advance ram and the roof support ram to achieve the energisation of advance ram and the roof support ram to achieve the energisation of advance rams prior to lowering the support canopy.

Clearly, a remote monitoring and control unit could be arranged to send over lines 20 separate advance solenoid energising and roof support solenoid energising command signals with a desired delay or a logic interlock dependent upon feed-back of pressure detection signals. Alternatively, a fine read-out of the advance ram extension could be provided, and the roof support lower signal sent only after the fine read-out signals had remained steady for a predetermined number of cycles, perhaps only one, of the remote control means. The latter operation would be temporary and would not result in accumulation to existing ram extension data at the control unit.

Other embodiments could utilise ram-extension measurement on pushing over a face conveyor prior to advancing the support itself. Then both of the above techniques specifically described, i.e. time delay or ram pressure sensing, could be used for getting signals to the remote control unit, but the requirement for interlocking with roof support ram release would not exist.

Figure 5:
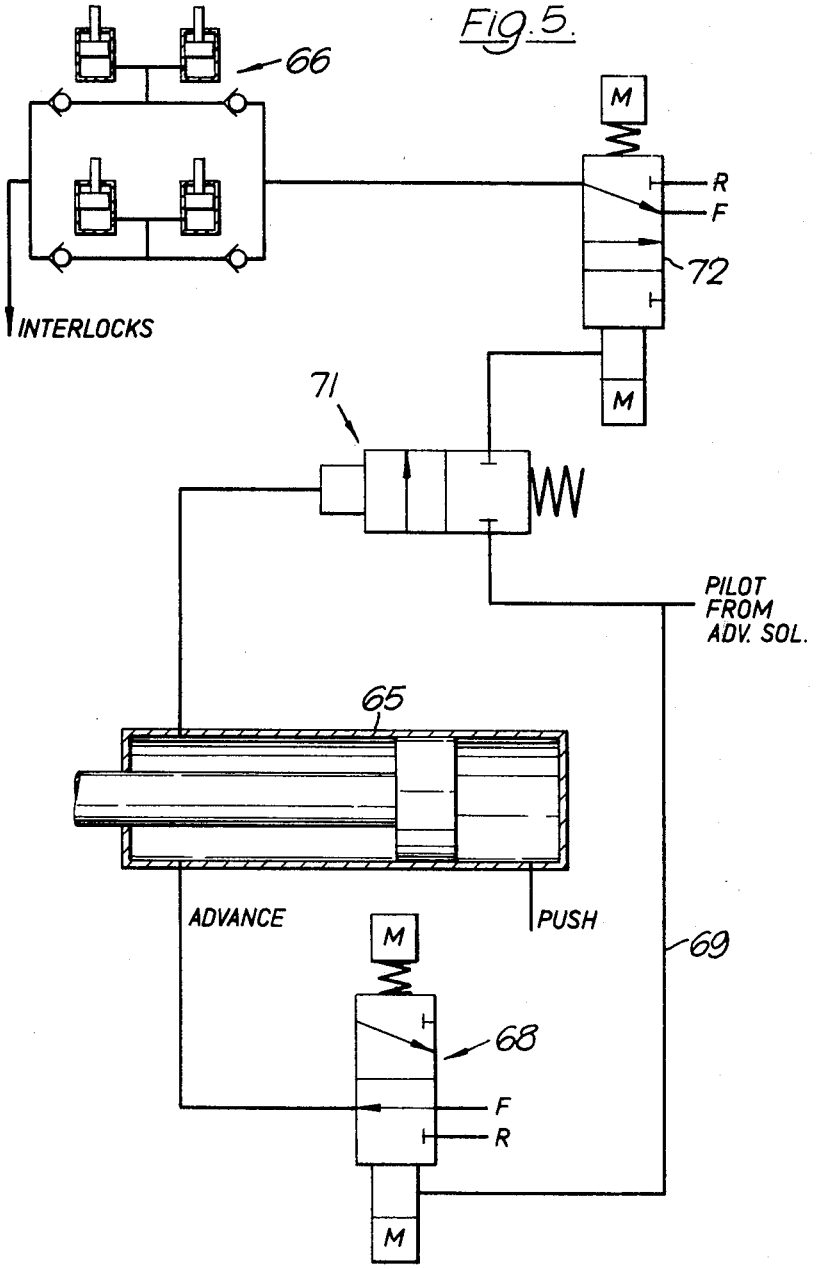
FIG. 5 is a schematic diagram of a pressure fluid interlocked control.

In the pressure fluid interlocked system of FIG. 5, the conveyor pushing/support advancing ram in indicated at 65 and the roof support props at 66 with appropriate non return valves to ensure safe operating conditions. A pilot operated control valve 68 for the ram 65 is shown as having drive and drain states for support advancing i.e. retraction of the piston or ram 65, with a safety bias to the drain state. In the drive state shown, pilot pressure is applied via branch line 69 when the support advance signal is received and operates the appropriate solenoid valve. The build up of pressure in the ram 65 will take up play in the mechanical couplings by the time a predetermined pressure is reached therein. This is sensed by a valve 71 with a preset or presettable bias so as to move from the position shown to its other position and cannot pilot pressure fluid over line 72 to a prop control valve 74 shown in its prop energising state and moved therefrom by such action of the valve 71 to cause connection of the rams to return for positive retraction if desired.

It will be appreciated that the pressure sensitive valve 71 could be connected anywhere in the supply line to the advance side of the advancing ram 65 and still sense the appropriate pressure to cause pilot operation of the valve 72, i.e. without requiring a separate connection to the cylinder of the ram 65. It is also to be understood that where, as often is the case, the pilot and main supplies are taken in common from one source, the pilot arrangement of the valve 72 may be made directly pressure sensitive so as to itself to provide the desired operation at a predetermined pressure.

What we claim is:

1. A system for monitoring the relative positions of a row of mine roof supports, comprising, for each of at least some of the supports, means for providing data relating to successive actual advances of each support and anchorage therefor, the system further comprising means for accumulating and storing such data for said at least some supports, and means for displaying the accumulated and stored data as an offset from a nominal or expected advance.

2. A system according to claim 1, wherein the data accumulated and stored comprises errors between actual advances and specified advance distances.

3. A system according to claim 2, wherein the error data is generated at units at each of said at least some supports.

4. A system according to claim 1, wherein the data is accumulated and stored at a control unit remote from the support.

5. A system according to claim 4, comprising a face conveyor constituting said mine roof support anchorage.

6. A system according to claim 5, wherein the data relates to extension of ram means acting between the support and the face conveyor on advancement of the latter.

7. A system according to claim 6, wherein means is provided at each of said at least some supports for ensuring that the ram means is pressurized before roof supporting props are released.

8. A system according to claim 7, wherein the last-mentioned means includes interlocking means between electricl solenoid actuated valve means for the ram means and the props.

9. A system according to claim 8, wherein the interlocking means is electrical.

10. A system according to claim 9, wherein the electrical interlocking means comprises delay means.

11. A system according to claim 9, wherein the electrical interlocking means comprises coincidence gating.

12. A system according to claim 8, wherein the interlocking means is pressure fluid operated.

13. A system according to claim 12, wherein the pressure fluid operated interlocking means includes means for sensing a predetermined pressure in the ram means.

14. A system according to claim 13, wherein the means for sensing is operative to control pilot operating pressure to prop control valve means.

* * * * *